United States Patent [19]

Altizer

[11] 4,325,819

[45] Apr. 20, 1982

[54] COAL WASHING PLANT

[76] Inventor: Dwight W. Altizer, 101 Wakefield Rd., Apt. A, Oak Ridge, Tenn. 37830

[21] Appl. No.: 190,651

[22] Filed: Sep. 25, 1980

[51] Int. Cl.[3] ..... B03B 9/00

[52] U.S. Cl. ..... 209/10; 209/12; 209/17; 209/172.5; 209/155; 210/732

[58] Field of Search ..... 209/2, 5, 17, 13, 18, 209/12, 172.5, 173, 155, 211, 10; 210/732–734

[56] References Cited

U.S. PATENT DOCUMENTS

| | | | |
|---|---|---|---|
| 2,654,479 | 10/1953 | Driessen | 209/211 X |
| 2,656,118 | 10/1953 | Chelminski | 209/10 X |
| 3,423,313 | 1/1969 | Messer | 210/734 |
| 3,579,442 | 5/1971 | Gerwig | 209/10X |
| 3,929,633 | 12/1975 | Visman et al. | 210/732 |
| 4,133,747 | 1/1979 | Visman | 209/5 X |
| 4,203,831 | 5/1980 | Parnaby | 209/452 X |

*Primary Examiner*—Ralph J. Hill

*Attorney, Agent, or Firm*—Pitts & Kesterson

[57] ABSTRACT

An apparatus and method for washing and recovering raw coal with no more than about 5% moisture and coal fines down to 200 mesh is disclosed. A complete washing plant having the ability to wash raw contaminated coal is disclosed. However, this invention is directed toward methods and apparatus for processing the coal slurry or effluent, and the wet coal obtained from a coal washing plant which methods and apparatus recovers coal fines down to 28 mesh. The apparatus and method of this invention separates the slurry which includes coal fines and contaminant material below 28 mesh by various screening and centrifugal processes such that coal fines down to 200 mesh are recovered. In addition, the methods and apparatus include various screens and centrifugal dryers for drying the wet coal thus recovering even more coal fines and reducing the moisture. The method and apparatus processes the effluents which include water and the contaminant materials such that the contaminant solids are removed from the water. The clarified water may then be reused in the coal washing process such that no more than 40–50 gallons of water per minute will be necessary for a washing plant having capability of handling 100–150 tons of coal per hour. The final clarifying process uses binding agents such as polymers so the smallest contaminant particles in the water are bonded into larger solids which then quickly settle out of the water so that they may be readily centrifuged and disposed.

16 Claims, 4 Drawing Figures

COAL WASHING PLANT

BACKGROUND OF THE INVENTION

This invention relates to methods and apparatus for washing raw coal and more particularly to methods and apparatus which has the ability for recovering coal fines down to 200 mesh without the addition of costly chemicals and the requirement of costly equipment.

In this period of critical energy shortages, the nations attention is being directed toward the development of alternate or plentiful sources of energy. One particular source of energy although not new, is becoming of great significance. This energy is, of course, coal. However, before coal can be used as a primary fuel in the generation of electrical energy and other industrial processes it requires treatment. For example, raw coal straight out of a mine often contains significant amounts of contaminant material such as slate, rocks, and other debris. Carefully mining only the center of a coal seam to eliminate or reduce most of the debris or contaminant materials is one approach, but this is not really satisfactory, as it leaves great quantities of coal at the edges of the seam. Therefore, to obtain a clean product, coal washing plants have been developed which remove the contaminant materials and debris from the coal. Unfortunately, the techniques of washing coal in the past resulted in significant loss of coal "fines". That is, coal material below 28 mesh or about 595 microns. Unfortunately, the objections to earlier available coal washing techniques is not only with respect to the loss of coal, but washing of such coal with water typically requires the use of a slurry or settling pond which in itself presents significant environmental dangers. Furthermore, it will be appreciated that although settling ponds may offer a solution (although unattractive) such ponds may typically require several acres for a large coal washing operation. Such a large amount of acreage of land may be available adjacent coal mines in parts of the western states, but it will be appreciated that most coal mining in the eastern states takes place in the mountains. Most eastern coal mines simply are not surrounded by several acres of suitable flat land for a settling pond. Thus, the settling ponds are not satisfactory in many situations because of large land requirements and the potential environmental dangers. Because of this problem, there have been in the past developed very large and costly coal washing plants. These plants, however, may typically run between 10 and 30 million dollars per installation. In addition, these plants are complex and require continuous and significant maintenance as well as continuous addition of costly chemicals such as magnatite to clean and clarify the water and remove the coal fines.

Although there are a great number of patents related to different components of a coal washing plant and for different types of coal washing plants, a typical example is U.S. Pat. No. 1,656,271 issued to C. R. Downs et al on Jan. 17, 1928. The apparatus of this patent illustrates various of the screens and settling tanks which are typically used in coal washing plants. This particular patent uses a process which requires a frothing agent for purposes of recovering the smaller coal. Unfortunately, the patent discloses the use of oil as the frothing agent, and with todays cost of oil this is completely unacceptable. According to the Downs technique, light weight coal fines are suspended and float with the oil to the top while the heavy weight debris, slate, and other materials settle to the bottom providing separation.

U.S. Pat. No. 4,040,961 issued to R. F. Davis, Jr. et al on Aug. 9, 1977, illustrates a more modern plant for the separating of solids from a liquid, and is particularly useful in separating coal and coal fines from a washing liquid. However, this patent also discloses the use of froth flotation which requires the use of significant amounts of chemicals for floating the light weight coal or coal particles away from the heavy weight solid debris and contaminant materials. The Davis patent is in no way capable of carrying out a complete washing cycle of the coal such that it also recovers coal fines down to 200 mesh, clarifies the water and eliminates need for a slurry pit.

Still another U.S. Pat. No. 4,104,128 issued to Paul B. Faber on Aug. 1, 1978, illustrates a complex apparatus and method for recovering coal fines. Although the Faber patent has the ability to recover exceedingly small coal fines, the process is unusually complex and expensive, and is incidental to a self contained system for charging preheated coal into coke ovens.

Various components are typically necessary in washing coal plants which are suitable for recovering ultra coal fines down to 100 mesh. However, none of these components themselves have the capacity for both recovering coal fines and clarifying water. As an example, U.S. Pat. No. 4,128,474 issued to Robert E. Ennis on Dec. 5, 1978 and assigned to Linatex Corporation of America, discloses a wet mechanical process for cleaning, upgrading, and dewatering fine coal. The process provides for forming an aqueous feed slurry of fine coal and its associated contaminant particles wherein all particles have a particle portion size of less than about 6 milimeters. The feed slurry is separated into coal slurry and refuse slurry portions in a spiral gravity concentrator by removing contaminates having a particle size greater than about 0.15 milimeters or 100 mesh. The concentrated coal slurry is then fed to a hydrocyclone separator where all of the ultrafine silt material having a particle size of less than 100 mesh is removed and the coal particles of 6 milimeters to 100 mesh is accumulated and dewatered. Although the apparatus described in this patent is certainly useful in the recovery of coal, it is still not a complete system which removes coal fines down to 200 mesh, reduces the amount of liquid necessary, eliminates the need for a slurry pit, and requires a building no greater than 40 feet by 60 feet.

Other particle separators such as that described in U.S. Pat. No. 3,608,717 and issued to David G. Strubel disclose various other techniques for separating particles of different specific gravities and absorption characteristics in a heavy liquid medium. The Strubel patent is particularly suitable for separating and recovering tobacco fines which would otherwise be lost.

Thus, it can be seen that although varied techniques have been attempted to wash coal and recover coal fines, they all have their problems such as cost or the inability to recover the ultrafine coal. Others require the huge amounts of additional costly chemicals, while still others require that great areas of land be available for slurry or settlement pits. Unlike, the present invention, none of the prior art techniques provide both method and apparatus which are both inexpensive and capable of recovering coal fines down to 200 mesh while at the same time eliminating slurry pits, and the need for huge amounts of water and space.

Therefore, it is an object of this invention to provide simple and inexpensive methods and apparatus for removing contaminant materials from raw coal.

It is still another object of this invention to provide method and apparatus for recovering ultrafine particles of coal which would otherwise be lost.

It is yet another object of this invention to provide method and apparatus for washing and recovering coal fines which is both inexpensive and which eliminates the need for slurry or settling ponds.

Another object of this invention is to clean slurry obtained from washing coal such that water can be reused.

It is still another object of this invention to provide methods and apparatus for washing and recovering coal fines which require minimum space and minimum maintenance.

To accomplish the above mentioned objects as well as other objects which will become evident from the following drawings and detailed description, the present invention provides a method and apparatus which processes the slurry, effluent, and the wet coal obtained when raw coal has been processed through a first and simple washing cycle. Typically, such a washing cycle may be of any suitable method known to those skilled in the art such as a barrel washer capable of recovering coal down to approximately 28 mesh and which has a resultant slurry containing a first group of coal and contaminant particles smaller than 28 mesh. In addition to the slurry, there is also typically an effluent which is comprised of larger groups of contaminate particles down to 28 mesh. The separation and recovery of smaller coal fines according to this invention is preferably accomplished by a cyclone or contrifugal separator which produces water and coal from said first group of particles and a second effluent comprised of water and contrifugal materials from said first group of particle. The resulting water and coal is then processed to obtain wet second coal having a selected size of between about 28 and 80 mesh, and a resulting second slurry which has a group of particles smaller than the particles of the first slurry. This processing step typically will include screening the water and the coal such that the larger particles of coal are recovered and the smaller particles of coal passes through with the water to form the slurry. The second or resulting slurry is then itself separated by means of a hydrocyclone separator or centrifugal separator to recover third coal fines between about 80 and 200 mesh. The cyclone separator also produces an effluent which is comprised of water, coal smaller than the 200 mesh, and contaminant materials. Thus, there has been described a process by which a slurry having coal fines of 28 mesh and smaller is processed to recover coal down to 200 mesh with a resulting effluent of contaminant particles and coal smaller than 200 mesh. The various effluents resulting from the original washing process and the processing to recover the coal between 28 by 200 mesh can itself be processed by separating the effluent into its component parts of water and contaminant materials. Screening of the effluent material from the first washing process results in large contaminant particles and a effluent of smaller size. An effluent having smaller contaminant particles may then be centrifuged to obtain solids and effluents containing still smaller solids and water. The smallest size of contaminant materials contained in the water are then recovered by adding a binding agent such as a polymer which collects and binds the ultrafine particles together so that they may be separated from the liquid thereby resulting in clarified water and contaminant solids which may be readily disposed of in any known manner.

Accordingly, the above mentioned objects and subsequent description will be more readily understood by reference to the following drawings.

DESCRIPTION OF THE INVENTION

Figure 1:
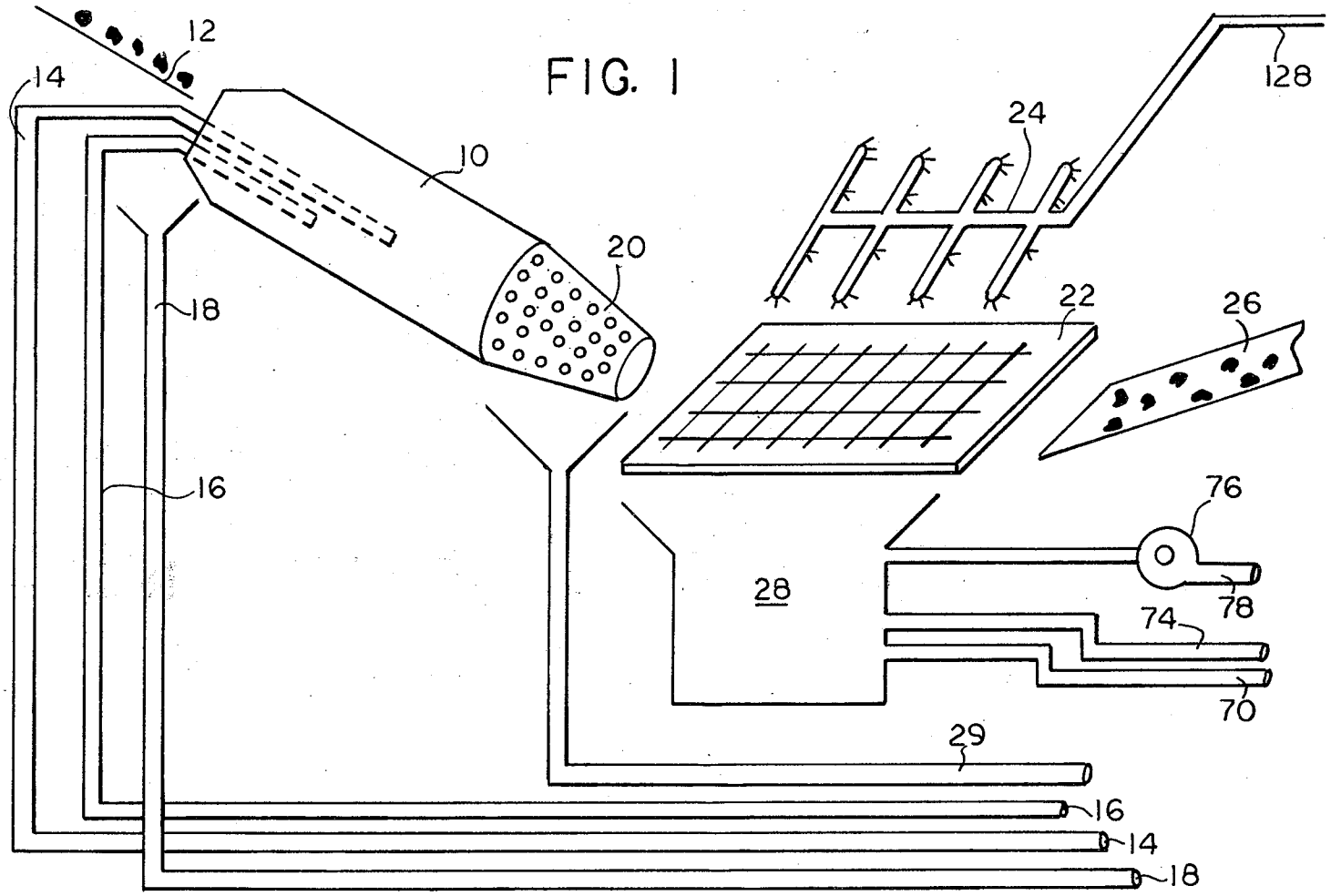
FIGS. 1 and 2 show the initial washing of raw coal for recovering coal fines down to approximately 28 mesh and includes a prior art barrel washer.
Figure 2:
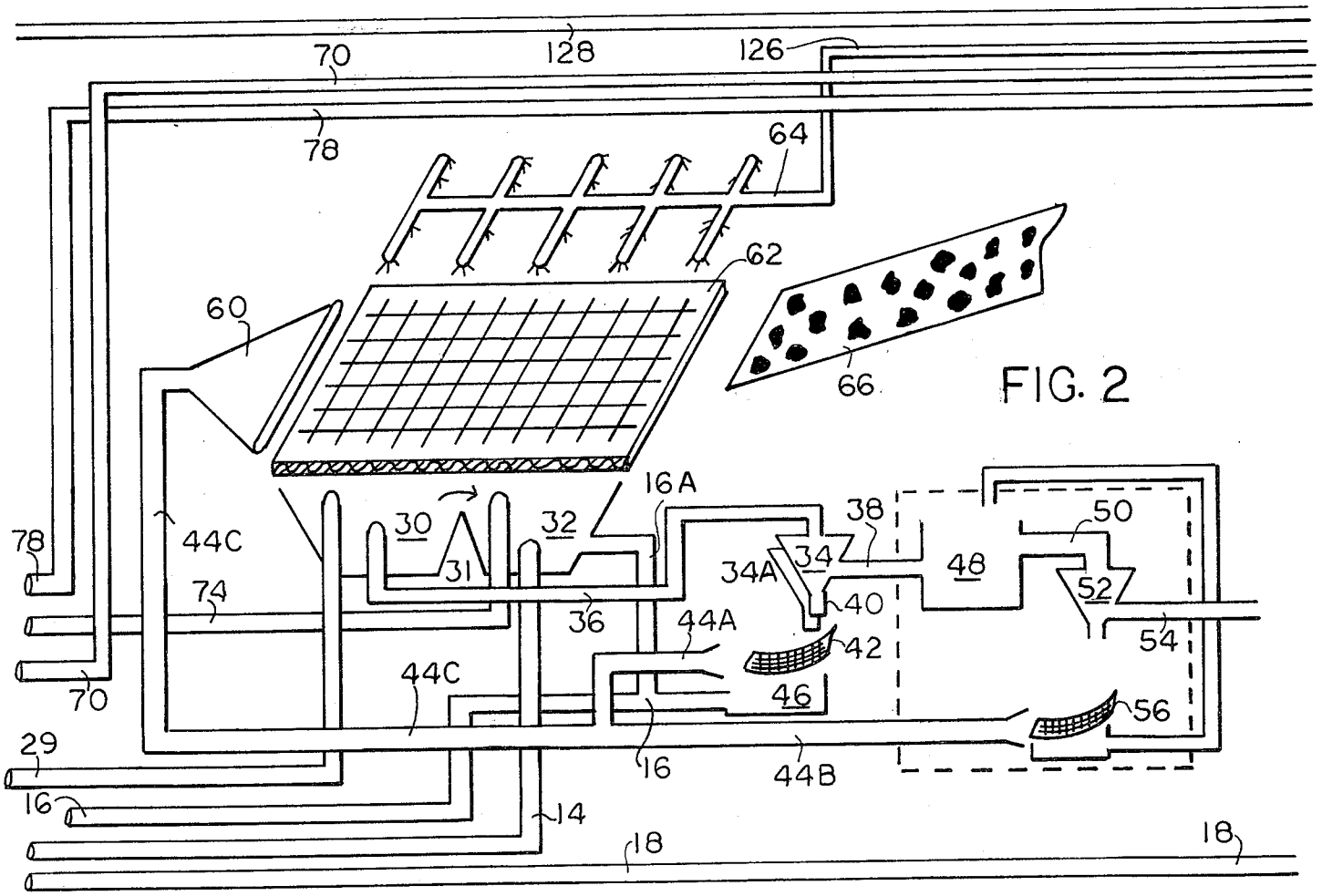

Referring now to FIGS. 1 and 2, there is shown a barrel washing technique for removing contaminant material and recovering coal fines down to approximately 28 mesh. Although any suitable technique for washing coal and recovering coal fines down to 28 mesh would be suitable for use by the technique of this invention, the described barrel washing technique has been found to be unusually inexpensive and useful with the process of this invention. As shown, raw coal from a mine which contains both coal and contaminant materials such as slate, rock, soil, and other debris, is introduced into barrel washer 10 by means of a conveyor loading belt 12. Barrel water is also introduced into barrel 10 by means of pipe 14 which water may be obtained from a selected location in the washing process such that it may include particles of small coal and debris. In addition, a media liquid is provided by means of pipe 16. The media liquid provided by line 16 is a composition of water in combination with a selected amount of particulate material or coal fines 28 mesh and smaller such that the specific gravity of the media liquid is precisely controlled for use with the washing barrel. This specific gravity may be selectively changed depending upon the particular type of raw coal being introduced into the barrel. For example, the specific gravity of coal varies depending upon the mine, and the type of coal. Further, as the contaminant material in the coal changes along with the size etc. of the coal, the liquid media may also be changed for the most effective use of the washing barrel. Although any washing barrel may be used, particularly effective is a barrel available from Coal Washing Rental Corp., of Ebensburg, Pa. which can receive raw material ranging from 3½" to 0 without prior screening or separation. In addition to the liquid media used by the barrel, the angle and rotational speed of the barrel may also be selected to obtain the maximum separating efficiency. To obtain the separation, the barrel uses a flowing film of the density controlled liquid media from conduit 16. The initial separation takes place inside the barrel as the coal is floated over an internal and stationary spiral. The reject material being heavier, of course, sinks as a result of the controlled gravity of the media and thus because of the fixed spiral is transported up the rotated barrel where this waste is discharged as an effluent comprised of water and refuse having a particle size of up to about three and one-half inches into a collecting conduit 18 located approximately at the entrance point of the raw material. The waste material collected by conduit 18 is hereinafter referred to as the first portion of the first effluent. The coal or resulting material which is floated through the barrel then passes a ½ inch rotating conical screen 20 attached to the end of barrel 10. The coal material which is greater than ½ inch is screened by this screen 20 and is deposited on a draining and rinse screen 22 which will have a selected mesh size, but according to a preferred embodiment is a 28 mesh or about 595 micron screen. The lumps of coal on screen 22 are then rinsed by water from spray 24. The washed coal larger than ½ inch is then deposited on conveyor belt 26 ready for use, whereas the water and coal smaller than the 28 mesh screen 22 passes through and is collected in a sump tank 28 and is hereinafter referred to as the first slurry which is further processed according to this invention as will be discussed hereinafter. Particles of coal and contaminant materials smaller than ½ inch pass through conical screen 20 and are collected and piped by conduit 29 to compartment 30 of a two part sump tank 30 and 32. Liquid and the larger and heavier particulate materials from tank 30 are then provided to a water only cyclone 34 by pipe 36. The lighter and fine matter flows over the dividing partitions 31 from compartment 30 and 32 for further processing as will be discussed hereinafter. Water only cyclone 34, of course, separates the heavier contaminant material of rock and slate from the lighter coal fines. This contaminant material is carried away by line 38. The coal fines discharged at output 40 are then passed over a 28 mesh screen 42. Particles of coal greater than 28 mesh do not pass through screen 42, of course, and are collected by conduit 44A. The liquid and particles passing through 28 mesh screen 42 are then collected by tank 46 from which they are carried by line 16 to barrel 10 as the liquid media discussed herein above. In addition, as shown in the embodiment of FIGS. 1 and 2, a branch line 16A to tank 32 is provided to collect any remaining liquid not necessary for use as part of the liquid media. Although a single hydrocyclone 34 would be sufficient if properly sized etc., it has been found that for convenient installation, and lower expense a second and parallel hydrocyclone 34A is particularly useful. In addition, for more effective recovery of coal fines a third hydrocyclone and screen connected in series is particularly useful. As shown, the reject from hydrocyclones 34 and 34A is carried by conduit 38 to holding tank 48. From tank 48, this combination of water and reject is carried by conduit 50 to the third and series connected cyclone 52 for further recovery of coal which remains in the reject from hydrocyclone 34. Hydrocyclone 52, also provides reject, of course, through conduit 54 which is referred to hereinafter as the second portion of the first effluent. The reject may include particles up to one-half inch in size which, as was discussed heretofore, pass through conical screen 20 prior to being separated by cyclons 34, 34A and 52. The recovered coal is then passed over a 28 mesh curved screen 56 in the same member as before with respect to screen 42. This coal is then collected by conduit 44B which joins conduit 44A to form conduit 44C. The particulate matter smaller than 28 mesh and water which passes through screen 56 is carried by conduit 58 to tank 48 for continuous recycling through cyclone 52 to maintain the specific gravity in the solution treated by cyclone 52. The coal collected by conduit 44C is carried to distribution head 60, where it is distributed across screen 62. The coal which consists of particles generally larger than 28 mesh is sprayed with clean water from spray heads 64 to wash and remove any remaining particulate matter smaller than 28 mesh. In the embodiment shown, screen 62 is over sump tank 30 and 32 discussed above where the material smaller than ½ inch from barrel 10 was collected. Thus, it will be appreciated that the liquid in sumps 30 and 32 is continually processed to assure that maximum efficiency of removing the 28 mesh and larger coal is obtained. As shown, after the coal is passed over 28 mesh screen 62, it is then carried by conveyor belt 66 for outside use, sale, etc.

Referring again to the cyclone separators 34 and 52, this particular embodiment illustrates the use of two cyclone stages for maximum efficiency. However, as was discussed it will be appreciated that a single stage cyclone, having the proper capabilities of a three stage cyclone would also be effective.

As was mentioned hereinabove, the reject or second portion of the first effluent carried from cyclone 52 by conduit 54 is an effluent which will be treated by the process of this invention and will be discussed in detail hereinafter. As discussed above a portion of the liquid and material smaller than 28 mesh passing through curve screen 42 is carried by means of conduct 16 to barrel 10 as media liquid while the remainder is carried by conduct 16A to compartment or tank 32. The accumulated liquid in compartment 32 is then pumped back to slurry or sump tank 28 by conduct 74 for collecting and later processing.

Referring again to barrel 10, and as was discussed heretofore, the particulate material greater than ½ inch which does not pass through conical screen 20 is passed over drain screen 22 which also has a mesh size of 28. As this material passes over screen 22, it receives a washing by spray arms 24 of clean water such that all of the particulate matter smaller than 28 mesh is washed from the coal and into collecting or sump tank 28. The washed coal from screen 22 is then moved by conveyor belt 26 to an outside collecting location where it is then available for use and/or sale.

Therefore, it will be appreciated that to this point there has been described a process for washing coal and recovering coal fines equal to or larger than 28 mesh. In addition, there is produced a waste discharge. This waste discharge includes a first slurry consisting of particles of coal and contaminant materials smaller than 28 mesh in combination with water, and a first effluent having a first portion collected by conduct 18 which includes contaminant particles greater than ½ inch, and a second portion of effluent from conduct 54 which includes contaminant particles substantially between ½ inch and 28 mesh. Various portions of the process and washing of coal and recovering of coal fines down to 28 mesh as described heretofore may be available in the prior art. Further, although the technique described heretofore has been found to be specifically suitable for use with the present invention, any similar or other washing technique which removes coal particles larger than approximately 28 mesh and leaves the remaining particles in a slurry would also be suitable for use with the process of the present invention described as follows.

Figure 3:
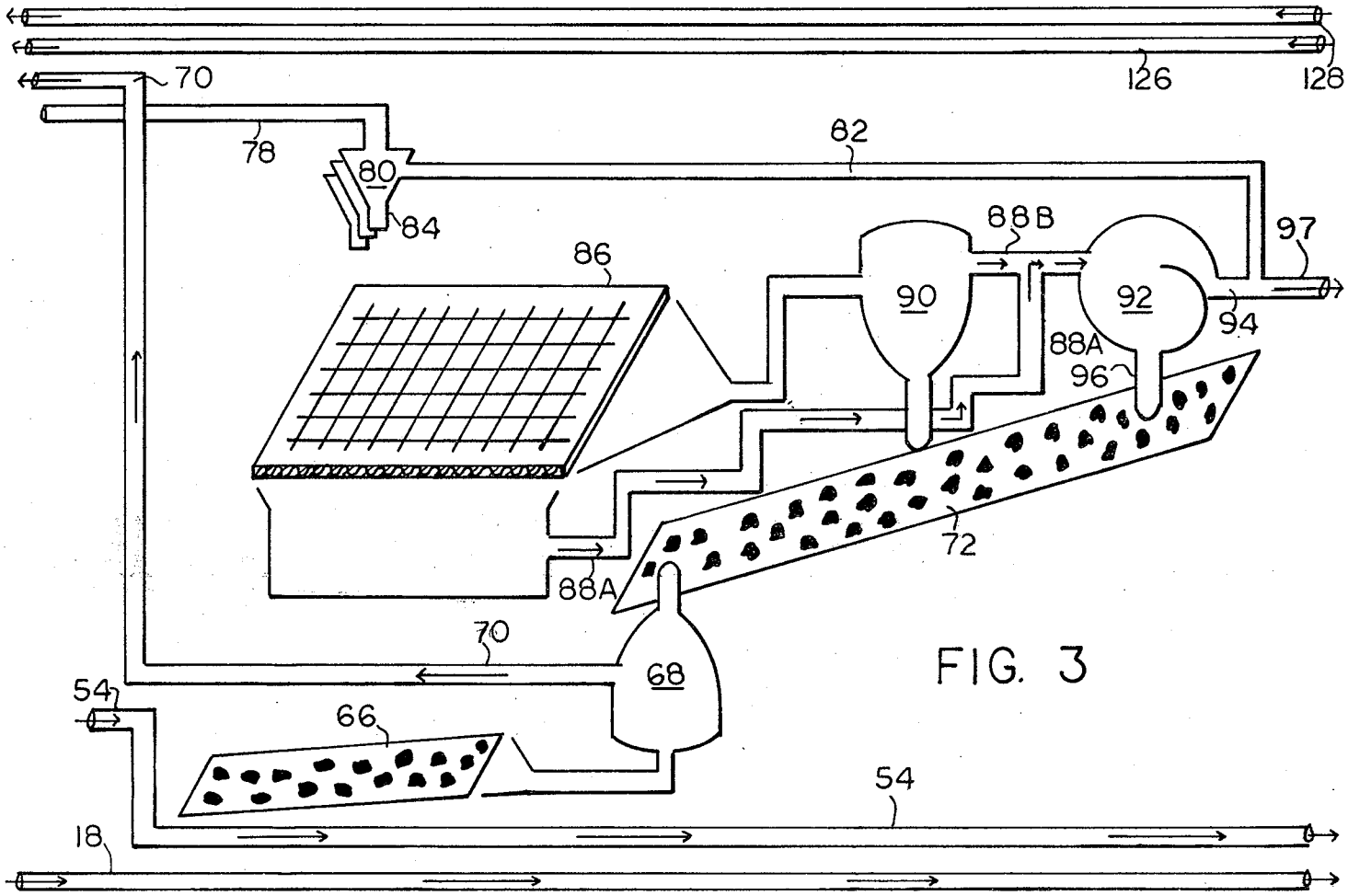
FIG. 3 illustrates the process and method of this invention for recovering coal fines between approximately 28 by 200 mesh.

Referring now to FIG. 3, there is shown a process for recovering still smaller coal fines between 28 mesh and 200 mesh. As shown, conveyor belt 66 containing ½ by 28 mesh coal as well as smaller coal fines adhering to the ½ by 28 mesh is provided to a centrifugal dryer 68, such as model EBW-36 available from "centrifugal Machine, Inc." of St. Louis. Centrifugal dryer 68 removes the liquid from the coal and returns it by means of conduit 70 to the settling or sump tank 28 heretofore discussed. The ½ inch by 28 mesh coal from dryer 68 is then deposited on the converyor 72 for delivery outside for use and sale. The slurry in collecting or sump tank 28, hereinafter referred to as the first slurry, is then provided by means of a pump 76 through conduit 78 to a cyclone separator 80, such as a "Townley" 6 inch classifying cyclone manufactured by Townley Engineering Manufacturing, Inc., Box 221, Candler, Florida, 32624. Cyclone separator 80 processes the coal and contaminant materials such that an hereinafter referred to as the second effluent of liquid and contaminant materials having a particle size smaller than 28 mesh is discharged through conduit 82. It will be appreciated that although three cyclone separators are shown connected in parallel for this step, three units would not be required so long as the selected unit had sufficient capacity. Cyclone separator 80 also provides wet coal having a particle size smaller than 28 mesh through aperture 84 to an 80 mesh screen 86. Screen 86 delivers coal having a particle size of between 28 and 80 mesh to a dryer to be discussed hereinafter. The water and coal having a particle size smaller than 80 mesh which passes through screen 86 forms a second slurry which is provided by means of piping 88A to another separator to be discussed hereinafter. The wet 28 by 80 mesh coal which does not pass through 80 mesh screen 86, is moved to dryer 90 which provides dry coal having a particle size of 28 by 80 mesh to conveyor belt 72. Dryer 90 is similar to dryer 68 discussed heretofore, and also produces an additional second slurry comprised of water and coal particles of less than 80 mesh which is carried by means of piping 88B to separator 92. Separator 92 processes the second slurry having a coal particle size of less than 80 mesh such that coal particles between 80 and 200 mesh are provided to conveyor belt 72 through outlet 96. A reject outlet to conduit 94 from separator 92 contains contaminant materials less than 80 mesh, water, and coal particles smaller than 200 mesh. Hereinafter, the reject from separator 92 may be referred to as the third effluent. The ½ by 28 mesh coal from dryer 68, the 28 by 80 mesh coal from dryer 90, and the 80 by 200 mesh coal from separator 92 is then carried by conveyor belt 72 to a suitable location for collection, use and/or sale. The third effluent from separator 92 carried by conduit 94 and also the second effluent from cyclone 80 carried by conduit 82 is then carried by conduit 97 for further processing by this invention for clarifying the used water, and thereby eliminating the need for a slurry pit.

Figure 4:
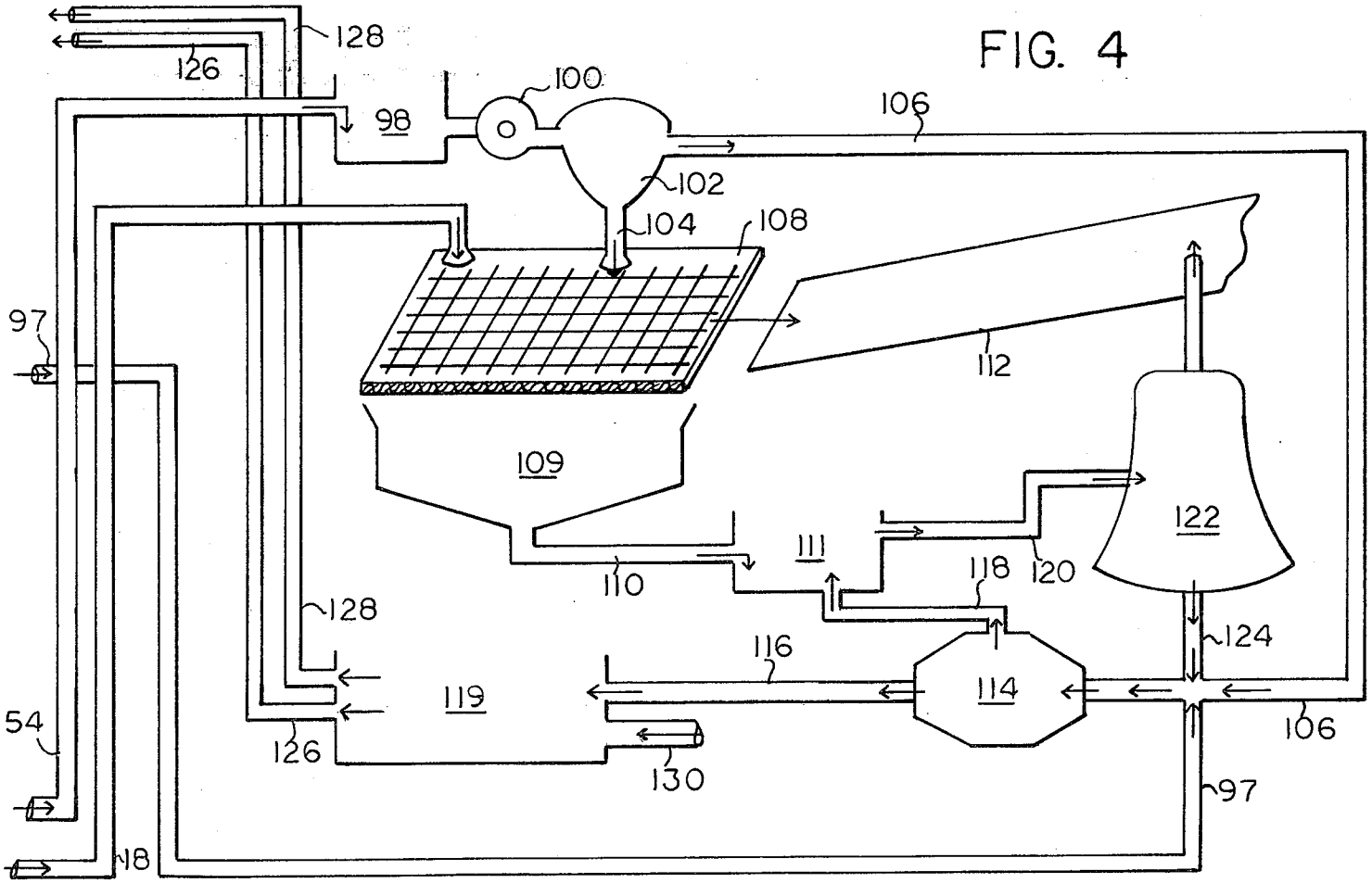
FIG. 4 illustrates the process of this invention for processing the effluent resulting from the coal washing to obtain clarified water and fine solid contaminant material held together by a binding agent for disposal.

As shown in FIG. 4, the first portion of the first effluent carried by conduit 18 containing the reject from washing barrel 12 which as was discussed heretofore receives raw material having a particle size up to three and one-half inches is provided to a vibrating screen discussed hereinafter. In addition, the second portion of the first effluent carried by conduit 54 from cyclone 52 which as was discussed heretofore includes contaminant particles up to one-half inch in size is provided by a conduit 54 to a collecting tank 98. The effluent in tank 98 is then moved by pump 100 to a separator 102 which separates the solids and the liquid from the effluent received from tank 98. Solids from separator 102 are routed by means of piping 104 to vibrating screen 108 which screen also receives the first portion of the first effluent from barrel 10 through conduit 18. It will be appreciated, of course, that the effluent moving to vibrating screen 108 includes contaminant particles and water. The liquid from the effluent collected in tank 98, and separated by means of separator 102 is then provided by piping 106 as an effluent comprised of liquid and contaminant solids having a selected particle size. The effluent in pipe 106, hereinafter referred to as the sixth effluent, is then provided to a water clarifier to be discussed hereinafter. The wet solids moved by conduit 104 to vibrating screen 108 along with the solids from washing barrel 10, then pass oer vibrating screen 108 such that the liquid and solids smaller than the mesh size selected for screen 108 are collected in a hopper 109 and routed by means of pipe 110 to a collecting tank 111. The solids too large to pass through vibrating screen 108 are moved to a reject belt 112 for disposal in a manner known to those skilled in the art. Water clarifier 114 collects the effluent from separator 102 by conduit 106, the second and third effluents carried by conduit 96 containing a particle size smaller than 28 mesh and rejected from separator 92 and cyclone 80 along with liquid from a centrifuge referred to as the fifth effluent and which will be discussed hereinafter. Water clarifier 114 may be any suitable unit such as, for example, a Serpac unit commercially available from Linatex Corporation. The water clarifying unit 114 receives the second, third, fifth, and sixth effluent, and combines this effluent with a premixed polymer flocculent solution for use as a binding agent. The polymers are carefully metered and combined with water for dilution such that the proper amount of flocculent is combined with the effluent prior to being received by a reaction chamber in the water clarifying unit. The reaction chamber allows the course and heavy solids to settle for easy removal of such refuse solids while the lighter material pass on to settling cells and distribution baffles. The refuse consists of small particles of contaminant material bound together by the bonding agent or polymer. These bonded particles then collect in a sludge hopper and settle to the bottom thereby leaving the clarified water. The sludge of bonded small contaminant particles is then discharged through pipe 118 into collecting tank 111 discussed heretofore. The clarified water from the unit 114 is provided through conduit 116 to a holding tank 119 to be discussed hereinafter. The liquid and solid material which passes through vibrating screen 108 and carried to collecting tank 111 by means of conduit 110, which is hereinafter referred to as the fourth effluent along with the solids from clarifying unit 114 are then pumped by means of conduit 120 to a centrifuge separator 122. Centrifuge separator 122 rejects the solid materials and these materials are moved by reject belt 112 for later disposal. The liquid, or fifth effluent, from centrifuge 122 containing particles of refuse is then returned to the clarifying unit 114 by means of pipe 124 for further water clarifying treatment. Thus, it will be appreciated that the solid output of the water clarifying unit is continuously passed through the centrifuge to remove the liquid from the dry refuse such that there is little liquid clinging to the dry refuse. At the same time, the liquid is continuously clarified so that it can be reused in the coal washing plant. As discussed, the output of clarified water through pipe 116 is collected in tank 118 for reuse. For example, conduit 126 provides water used by spray arms 64 above screen 62, and conduit 128 provides water to spray arms 24 above screen 18 which as was discussed heretofore was used in washing the coal. Because of evaporation and some moisture which continues to cling to the various coal and refuse particles, pipe 130 is provided for introducing fresh water to replace that used during the process. It will be appreciated that unlike prior art coal washing plants, however, the fresh water rate may typically be as low as 40 to 50 gallons per minute as opposed to the 3000 to 6000 gallons per minute used in some coal washing plants. In addition, it will be appreciated because of the recycled water and the dry refuse carried away by belt 112 the need for a slurry pit has been eliminated.

Thus, although the present invention has been described with respect to specific method and apparatus suitable for washing coal and recovering coal fines down to 200 mesh, it is not intended that such specific references be considered as limitations upon the scope of this invention except insofar as set forth in the following claims.

I claim:

1. Apparatus for processing effluent resulting from washing coal to recover and clarify water suitable for reuse comprising:

means for screening at least a portion of said effluent to obtain another effluent having particles smaller than particles included in said effluent and dry contaminant particles larger than a first selected size;

means for centrifuging said another effluent along with solids from a water clarifying unit, said solids consisting of contaminant particles bonded together by a binding agent, to obtain solids and a different effluent; and means for adding a polymer flocculent binding agent and processing said another effluent, said different effluent, and the remaining portions of said effluent to obtain clarified water and solids consisting of particles of contaminant materials held together by said binding agent.

2. Processing effluent resulting from wasing coal to recover and clarify water suitable for reuse comprising the steps of:

screening at least a portion of said effluent to obtain another effluent having particles smaller than particles included in said effluent and dry contaminant particles larger than a first selected size;

centrifuging said another effluent along with solids from a water clarifying unit, said solids consisting of contaminant particles bonded together by a binding agent to obtain solids and a different effluent; and adding a polymer flocculent binding agent and processing said another effluent, said different effluent, and the remaining portion of said effluent to obtain clarified water and solids consisting of small particles of contaminant materials held together by said binding agent.

3. In apparatus for washing raw coal to remove contaminant materials by adding water to raw coal which is then washed and screened such that a first coal is obtained, whereby substantially all particles of said first coal are greater than a first selected size of about 28 mesh; and wherein a discharge of waste is obtained, said waste discharge including a first slurry having water and a first group of particles of coal and contaminant material smaller than said first selected size of about 28 mesh; and wherein a first effluent of water and contaminant particles is obtained, a first portion of said first effluent containing contaminant particles; improved apparatus for recovering coal fines having a particle size smaller than said first selected size of about 28 mesh comprising:

means for separating said first slurry to obtain wet coal having a particle size smaller than said first selected size of about 28 mesh and said effluent;

means for screening said wet coal separated from said first slurry to obtain a second slurry comprised of water and second group of particles having a particle size smaller than a second selected size, which said second selected size is smaller than said first size, and wet second coal having a particle size between said first selected size and said second selected size; and means for separating said second slurry to substantially separate said second group of particles into third coal having a particle size smaller than said second selected size and larger than a third selected size, and said effluent.

4. Amended in apparatus for washing raw coal to remove contaminant materials by adding water to raw coal which is then washed and screened such that a first coal is obtained, wherein substantially all particles of said first coal are greater than a first selected size of about 28 mesh; and wherein a discharge of waste is obtained, said waste discharge including a first slurry having water and a first group of particles of coal and contaminant material smaller than said first selected size of about 28 mesh, and a first effluent having water and contaminant particles, a first portion of said first effluent containing contaminant particles greater than said first selected size of about 28 mesh and a second portion of said first effluent containing contaminant particles smaller than said first selected size of about 28 mesh; improved apparatus for recovering coal fines having a particle size smaller than said first selected size of about 28 mesh comprising:

means for separating said first slurry to obtain wet coal having a particle size smaller than said first selected size of about 28 mesh, and a second effluent comprised of water and contaminant material having a particle size smaller than said first selected size;

means for screening said wet coal separated from said first slurry to obtain a second slurry comprised of water and a second group of particles having a particle size smaller than a second selected size, which said second selected size is smaller than said first size, and wet second coal having a particle size between said first selected size and said second selected size; and means for separating said second slurry to substantially separate said second group of particles into third coal having a particle size smaller than said second selected size and larger than a third selected size, and third effluent comprised of water, coal particles smaller than said third selected size, and contaminant material having a particle size smaller than said second selected size.

5. The apparatus of claim 4 and further including apparatus for recovering and clarifying water for reuse from said first, second and third effluents comprising:

means for screening said first effluent to obtain a fourth effluent of water and a group of particles of contaminant material smaller than said first selected size of about 28 mesh, and contaminant material larger than said first selected size;

Best Available Copy means for centrifuging said fourth effluent along with solids from a water clarifier consisting of small particles of contaminant materials bonded together by a binding agent to obtain solid refuse and a fifth effluent; and means for adding a polymer flocculent binding agent and processing said second, third, and fifth effluents to obtain clarified water and solids consisting of smaller particles of contaminant materials held together by said binding agent.

6. In a process for washing raw coal to remove contaminant materials by adding water to raw coal which is then washed and screened such that a first coal is obtained, wherein substantially all particles of said first coal are greater than a first selected size of about 28 mesh; and wherein a discharge of waste is obtained, said waste discharge including a first slurry having water and a first group of particles of coal and contaminant material smaller than said first selected size of about 28 mesh, and a first effluent having water and contaminant particles: a first portion of said first effluent containing contaminant particles greater than said first selected size of about 28 mesh and a second portion of said first effluent containing contaminant particles smaller than said first selected size of about 28 mesh; and improved process for recovering coal fines having a particle size smaller than said first selected size of about 28 mesh and for recovering and clarifying water for reuse comprising the steps of:

drying a portion of said first coal to obtain additional first slurry;

separating said first slurry and said additional first slurry to obtain wet coal having a particle size smaller than said first selected size of about 28 mesh, and a second effluent comprised of water and contaminant material having a particle size smaller than said first selected size;

screening said wet coal separated from said first slurry to obtian a second slurry comprised of water and a second group of particles having a particle size smaller than a second selected size, which said second selected size is smaller than said first size, and wet second coal having a particle size between said first selected size and said second selected size;

drying said wet second coal to obtain additional second slurry and dry second coal;

separating said second slurry and said additional second slurry to substantially separate said second group of particles into third coal having a particle size smaller than said second selected size and larger than a third selected size, and third effluent comprises of water, coal particles smaller than said third selected size, and contaminant material having a particle size smaler than said second selected size;

screening said first effluent to obtain a fourth effluent of water and a group of particles of contaminant material smaller than said first selected size of about 28 mesh, and contaminant material larger than said first selected size;

centrifuging said fourth effluent along with solids consisting of small particles of contaminanat materials bonded together by a binding agent from a water clarifier to obtain solid refuse and a fifth effluent; and adding a polymer flocculent binding agent and processing said second, third, and fifth effluents to obtain clarified water and solids consisting of small particle of contaminant materials held together by said binding agent.

7. In a process for washing raw coal to remove contaminant materials by adding water to raw coal which is then washed and screened such that a first coal is obtained, wherein substantially all particles of said first coal are greater than a first selected size of about 28 mesh; and wherein a discharge of waste is obtained, said waste discharge including a first slurry having water and a first group of particles of coal and contaminant material smaller than said first selected size of about 28 mesh and a first effluent having water and contaminant particles, a first portion of said first effluent containing contaminant particles greater than said first selected size of about 28 mesh and a second portion of said first effluent containing contaminant particles smaller than said first selected size of about 28 mesh; and improved process for recovering coal fines having a particle size smaller than said first selected size of about 28 mesh and for recovering and clarifying water for reuse comprising the steps of:

drying a portion of said first coal to obtain additional first slurry;

separating said first slurry and said additional first slurry to obtain wet coal having a particle size smaller than said first selected size of about 28 mesh, and second effluent comprised of water and contaminant material having a particle size smaller than said first selected size;

screening said wet coal separated from said first slurry to obtain a second slurry comprised of water and a second group of particles having a particle size smaller than a second selected size, which said second selected size is smaller than said first size, and wet second coal having a particle size between said first selected size and said second selected size;

drying said wet second coal to obain additional second slurry and dry second coal;

separating said second slurry and said additional second slurry to substantially separate said second group of particles into third coal having a particle size smaller than said second selected size and larger than a third selected size, and third effluent comprised of water, coal particles smaller than said third selected size, and contaminant material having a particle size smaller than said second selected size;

screening said first effluent to obtain a fourth effluent of water and a group of particles of contaminant material smaller than said first selected size of about 28 mesh, and contaminant material larger than said first selected size;

centrifuging said fourth effluent along with solids consisting of small particles of contaminant materials bonded together by a binding agent from a water clarifier to obtain solid refuse and a fifth effluent; and adding a polymer flocculent binding agent and processing said second, third, and fifth effluents to obtain clarified water and solids consisting of small particle of contaminant materials held together by said binding agent.

8. The process of claim 7 and further including the step of separating at least a portion of said first effluent into contaminant materials and a sixth effluent comprised of water and contaminant materials and wherein said step of adding a binding agent and processing effluents also includes processing said sixth effluent.

9. In a process for washing a raw coal to remove contaminant materials by adding water to raw coal which is then washed and screened such that a first coal is obtained wherein substantially all particles of said first coal are greater than a first selected size of about 28 mesh; and wherein a discharge of waste is obtained, said waste discharge including a first slurry having water and a first group of particles of coal and contaminant material smaller than said first selected size of about 28 mesh, and an effluent of water and contaminant particles;

an improved process for recovering coal fines having a particle size smaller than said first selected size of about 28 mesh comprising the steps of:

separating said first slurry to obtain wet coal having a particle size smaller than said first selected size of about 28 mesh and said effluent;

screening said wet coal separated from said first slurry to obtain a second slurry comprised of water and a second group of particles having a particle size smaller than a second selected size, which said second selected size is smaller than said first size, and wet second coal having a particle size between said first selected size and said second selected size; and separating said second slurry to substantially separate said second group of particles into third coal having a particle size smaller than said second selected size and larger than a third selected size, and said effluent.

10. In a process for washing raw coal to remove contaminant materials by adding water to raw coal which is then washed and screened such that a first coal is obtained wherein substantially all particles of said first coal are greater than a first selected size of about 28 mesh; and a wherein a discharge of waste is obtained, said waste discharge including a first slurry having water and a first group of particles of coal and contaminant material smaller than said first selected size of about 28 mesh, and a first effluent having water and contaminant particles, a first portion of said first effluent containing contaminant particles greater than said first selected size of about 28 mesh and a second portion of said first effluent containing contaminant particles smaller than said first selected size of about 28 mesh; an improved process for recovering coal fines having a particle size smaller than said first selected size of about 28 mesh comprising the steps of:

separating said first slurry to obtain wet coal having a particle size smaller than said first selected size of about 28 mesh and a second effluent comprised of water and contaminant material having a particle size smaller than said first selected size;

screening said wet coal separated from said first slurry to obtain a second slurry comprised of water and a second group of particles having a particle size smaller than a second selected size, which said second selected size is smaller than said first size, and wet second coal having a particle size between said first selected size and said second selected size; and separating said second slurry to substantially separate said second group of particles into third coal having a particle size smaller than said second selected size and larger than a third selected size, and third effluent comprised of water, coal particles smaller than said third selected size, and contaminant material having a particle size smaller than said second selected size.

11. The process of claim 10 and further including recovering and clarifying water from said first, second and third effluents such that said clarified water may be reused, said recovering and clarifying water comprising the steps of:

screening said first effluent to obtain a fourth effluent of water and a group of particles of contaminant material smaller than said first selected size of about 28 mesh, and contaminant material larger than said first selected size;

centrifuging said fourth effluent along with solids consisting of small particles of contaminant materials bonded together by a binding agent from a water clarifier to obtain solid refuse and a fifth effluent; and adding a polymer flocculent binding agent and processing said second, third, and fifth effluents to obtain clarified water and solids consisting of small particles of contaminant material held together by said binding agent.

12. The process of claim 11 and further including the step of separating at least a portion of said first effluent into contaminant materials and a sixth effluent comprised of water and contaminant materials and wherein said step of adding a binding agent and processing effluents also includes processing said sixth effluent.

13. The process of claim 9 or 10 and further including drying said wet second coal to obtain additional second slurry and dry second coal.

14. The process of claim 13 and further including the step of drying a portion of said first coal to obtain additional first slurry.

15. The process of claim 14 wherein said second selected size is about 80 mesh, said third selected size is about 200 mesh, and wherein said second coal has a particle size between about 28 and 80 mesh, and said third coal has a particle size between about 80 mesh and 200 mesh.

16. The process of claims 6, 7, 9, 10, 13, 14 or 15 wherein said first slurry is obtained by washing raw coal with a barrel washer.

* * * * *